United States Patent [19]

Fujii

[11] 4,297,133

[45] Oct. 27, 1981

[54] METHOD AND MEANS FOR ADDING TREATING AGENT FOR MOLTEN METAL

[75] Inventor: Kenji Fujii, Nishinomiya, Japan

[73] Assignee: Yoshida Iron Works Co., Ltd., Hyogo, Japan

[21] Appl. No.: 127,203

[22] Filed: Mar. 4, 1980

Related U.S. Application Data

[63] Continuation of Ser. No. 907,587, May 19, 1978, Pat. No. 4,200,456, which is a continuation-in-part of Ser. No. 799,000, May 20, 1977, abandoned.

[30] Foreign Application Priority Data

| | | | |
|---|---|---|---|
| Jul. 15, 1976 | [JP] | Japan | 51/84806 |
| Jul. 22, 1976 | [JP] | Japan | 51/87983 |
| Jul. 23, 1976 | [JP] | Japan | 51/88373 |
| Sep. 16, 1976 | [JP] | Japan | 51/111521 |
| Sep. 16, 1976 | [JP] | Japan | 51/111522 |
| Sep. 16, 1976 | [JP] | Japan | 51/111523 |

[51] Int. Cl.[3] ..... C22B 9/00

[52] U.S. Cl. ..... 75/53; 75/58; 75/93 G

[58] Field of Search ..... 75/53–58, 75/93 G

[56] References Cited

U.S. PATENT DOCUMENTS

| | | | |
|---|---|---|---|
| 1,322,496 | 11/1919 | Henderson | 75/53 |
| 1,848,323 | 3/1932 | Davies | 75/93 G |
| 2,509,281 | 5/1950 | Tidale | 75/93 G |

*Primary Examiner*—P. D. Rosenberg

*Attorney, Agent, or Firm*—Armstrong, Nikaido, Marmelstein & Kubovcik

[57] ABSTRACT

A method of and a member for adding a treating agent for molten metal, wherein an additive or treating agent such as a desulfurizing agent or a deoxidizing agent is enclosed in a container made of a self-burnable and self-eruptive material and the container is inserted into the molten metal by dropping it or by making use of a support rod or a plumbing device to produce physical and chemical reactions, which induce agitation and convection in the molten metal, the synergistic effect of such actions causing the treating agent to be effectively added to the molten metal.

13 Claims, 20 Drawing Figures

METHOD AND MEANS FOR ADDING TREATING AGENT FOR MOLTEN METAL

CROSS-REFERENCES TO RELATED APPLICATION

This is a continuation of Ser. No. 907,587 filed May 19, 1978 now U.S. Pat. No. 4,200,456 which is a continuation-in-part of Ser. No. 799,000 filed May 20, 1977, abandoned.

BACKGROUND OF THE INVENTION

1. Field of the Invention

The present invention relates to a method of and a member for adding a treating agent in a molten-metal treating process, for example, desulfurization or deoxidation, or in a component adjusting process.

2. Description of the Prior Art

In the case of desulfurization, for example, recently the requirements for limitation on sulfur content (hereinafter referred to as S content) have become very severe, and depending on applications, a so-called low-sulfur steel with an S content of less than 50 ppm is demanded. Therefore, with the present-day steel making method using a blast furnace-converter system, and theoretically, it is necessary to carry out sufficient desulfurization in the converter, that is, on the stage prior to steel making, so as to prepare a molten metal with an S content below the limit which allows refining in the steel making process. On the other hand, the circumstances of materials in the blast furnace are assuming an aspect which does not warrant optimism, making it difficult to obtain a molten metal with an S content below the refinable limit as described above.

It is the outside-furnace desulfurization of molten iron that has made its advent as the most effective method of pre-treatment of or low-sulfur steel making from a molten metal which has a high S content due to such circumstances of the blast furnace. At present, various outside-the-furnace desulfurization systems have been invented and put to use. For example, the addition and agitation method, blowing-in method, etc. are usually employed.

The addition and agitation method uses a plunging member to plunge a desulfurizing agent and auxiliary agent packed in a drum can or the like into molten steel taken out into a ladle and agitate the same. With this, however, the initial cost is high owing to the installation of the drive unit, etc., and on top of this, the plunging member has to be frequently replaced since it can be easily melt-wise damaged, thus involving high running cost. Further, the sulfur which has once floated up to the surface of the melt as a slag tends to return to the molten steel or some of the desulfurizing agent and auxiliary agent burn out before they reach suitable positions in the molten steel, so that more amounts of desulfurizing agent and auxiliary agent than is necessary are consumed.

According to the blowing-in method, after a desulfurizing agent and auxiliary agent are charged into molten steel by a plunging member or the like, desulfurization is carried out by blowing $N_2$ gas into the molten steel with the ladle sealed. In this case also, drawbacks similar to those described above in connection with the addition and agitation method remain unsolved.

In brief, in the conventional methods, the yield of a desulfurizing agent and its auxiliary agent (hereinafter referred to as treating agent) is generally low and the treating operation requires a long residence time (20–25 minutes), involving a loss of the thermal energy of the molten steel. Further, what should be particularly noted is that while recent researches have developed various types of desulfurizing agents, no decisive method of use, or addition, of such agents has been established. As a result, the costs of expensive installation and replaceable members such as plunging members and the useless consumption of more than necessary amount of treating agent have extremely raised the initial cost and the running cost.

Further, since a large amount of treating agent is charged into molten steel at a single place therein, the resulting chemical reaction is violent, involving danger and producing smoke and dust in large amounts, incurring the possibility of causing environmental pollution, such as air pollution. On top of this, the treating effect is good only at the charged place and agitation for a prolonged period of time is required in order to uniformly distribute the treating effect throughout the molten metal in the ladle.

Further, referring to the outside-the-furnace deoxidizing of molten steel, among the most general methods of adding a deoxidizing agent is one in which it is formed into a lump which is then charged into molten steel and another in which it is formed into a shell which is then shot into molten steel. With these methods, however, the deoxidizing agent tends to burn or float up (depending upon specific gravity) before it produces chemical reactions in the molten steel for deoxidation and hence it has been usual practice to charge more than the necessary amount of treating agent but the scattering of deoxidation yield cannot be avoided. Thus, in the conventional methods, stabilized deoxidation yield cannot be obtained despite the use of a large amount of treating agent.

SUMMARY OF THE INVENTION

An object of the present invention is to remedy or eliminate the drawbacks heretofore involved in adding treating agents to molten metal.

Another object of the invention is to prevent the return of sulfur and the burn-out loss of treating agent caused before it comes into molten metal, thereby improving the treating effect and the yield of treating agent.

A further object of the invention is to dispense with the plunging member, agitating member and drive unit therefor, thereby reducing the initial cost and running cost involved in the treatment of molten metal.

An additional object of the invention is to cut down the residence time of molten metal in the treating process, which tends to cause a loss of the thermal energy of molten metal.

Yet another object of the invention is to protect the quality of the treating agent by preventing the weathering thereof due to its time-dependent changes or by preventing spontaneous ignition during storage or transport.

A feature of the invention is that a capsule made of a self-burnable and self-eruptive material harmless to molten metal with a treating agent contained therein, that is, a treating agent adding member is dropped or plunged into molten metal and the self-burnable and self-eruptive actions of the capsule are utilized to cause agitation and convection of the treating agent and molten metal. Thereby, the equipment including the agitating member and drive therefor can be dispensed with. Since molten metal is not forcibly agitated, even if a plunging member is used the surface of the melt is maintained undisturbed and the return of sulfur which has once slagged is prevented.

Another feature of the invention is that a plurality of said treating agent adding members each packed with a suitable amount of treating agent are plunged into molten metal once or several times, thereby uniforming the addition of the treating agent and cutting down the treating time and hence minimizing the loss of the thermal energy of the molten metal.

A further feature of the invention is that a treating agent adding member comprises a tubular body made of a self-burnable and self-eruptive material, for example, kraft paper cylindrically wound in layers, with an air layer being formed between adjacent paper layers, a lid and a weight each made of a material which, even if melted, is harmless to molten metal. This arrangement protects the treating agent packed in the interior from pre-burning and denaturing and improves the yield of treating agent. Further, it enables the efficient addition of the treating agent by adjusting the burning initiation time and burning time by adjusting the weight of said weight and the thickness of said paper tube. The tubular body is spirally wound in layers with an air layer formed between the edges of the adjacent spiral layers.

Other numerous novel points and special qualities which characterize the present invention will be described in detail with reference to the accompanying drawings illustrating embodiments of the invention.

BRIEF DESCRIPTION OF THE DRAWINGS

FIGS. 15 and 16 show a modification wherein the member shown in FIG. 14 is improved, in which FIG. 15 is a longitudinal section and FIG. 16 is a front view;

DESCRIPTION OF THE PREFERRED EMBODIMENTS

Figure 2:
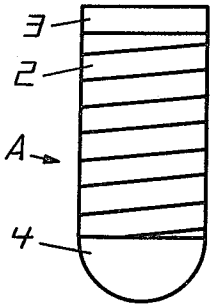
FIG. 2 is a front view of the member shown in FIG. 1.
Figure 1:
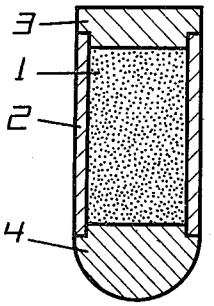

In FIGS. 1 and 2 showing a treating agent adding member according to a first embodiment of the invention, a treating agent is designated at 1 and 2 designates a paper tube containing the treating agent 1, with its opposite ends tightly closed by a lid 3 and a weight 4.

Figure 2A:
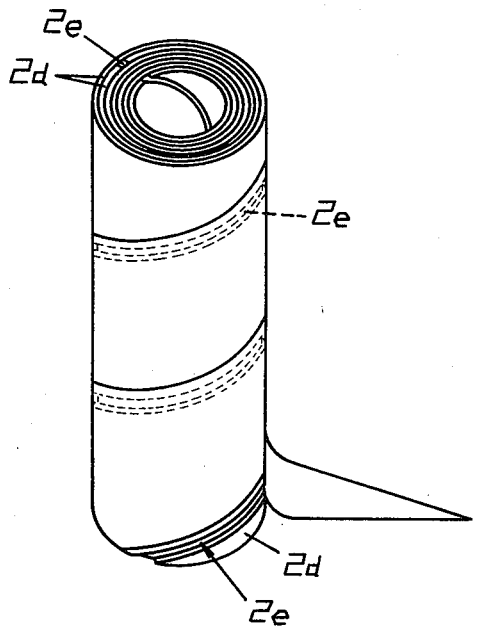
FIG. 2*a* is a perspective view of the treating agent adding member paper tube, partially unwound.

The paper tube 2 is formed of a self-burnable and self-eruptive material, for example, kraft paper cylindrically wound in layers. An air layer is formed between adjacent paper layers, and it takes some time for combustion to proceed from the outermost to the innermost paper layer, whereby the self-burning oxidation, that is, the loss of the treating agent 1 packed in the interior is prevented from occurring before the treating agent reaches a suitable position in molten metal. As seen in FIG. 2*a*, the paper 2*d* is spirally wound in layers with air layer 2*e* formed therebetween. The self-burning of the paper tube is carried out by virtue of the existence of the air layers 2*e*. The combustion time of the paper tube 2 varies with its wall thickness. According to experience with a converter, in the case of a wall thickness of 3 mm, the paper tube traveled for 10 seconds while receiving radiant heat in the furnace and combustion in molten steel at 1600°–1700° C. took about 3 seconds before it completed. The material of which the lid 3 and weight 4 are made should be such that it will not adversely affect the components of molten metal to be treated, and the weight 4 has its front end shell-shaped so that it is capable of breaking through molten metal surface when it enters the molten metal.

Figure 5:
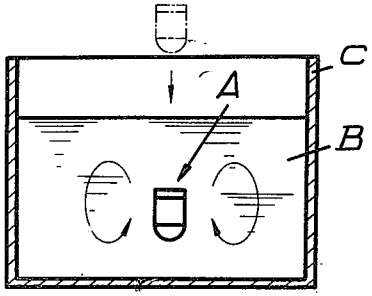

In FIG. 5 showing the manner of treatment in this case, the treating agent adding member, that is, capsule of the above construction, is designated at A. When the capsule A is dropped into molten metal B taken into a ladle C, the treating agent 1 reaches a suitable reaction start position in the molten metal B without self-burning and oxidizing in advance. Such reaction start position can be suitably determined by adjusting the weight of the weight 4 or the wall thickness of the paper tube 2 according to calculations of the specific gravities of the capsule A and molten metal B. The self-burning of the paper tube 2 and the resulting emission of combustion gas at a suitable position in the molten metal B induce the agitation and convection of the molten metal and enhance the addition of the treating agent.

Figure 3:
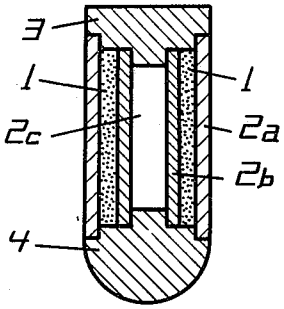

In order to make more effective the agitation and convection of the molten metal, as shown in FIG. 3, the paper tube may be arranged in multiple construction (double construction in the illustrated example) including a central paper tube 2*b* having a hollow space 2*c*, with the treating agent 1 packed in a hollow space defined by the outer paper tube 2*a*. The outer paper tube 2*a* functions to prevent the loss of the treating agent 1 until it reaches the reaction start position, while the inner paper tube 2*b* enhances the blowing of the treating agent 1 by its combustion and by the concomitant emission of the air in the hollow space 2*c* and hence it enhances the agitation of molten metal. Further, in order to make uniform the addition of the treating agent, several capsules each packed with a suitable amount of treating agent may be charged into molten metal at suitable positions.

In the past, when the amount of molten metal to be treated was increased, the treating equipment became larger in size and more complicated and the treatment took a longer time. According to the present invention, however, no complicated apparatus is required and the operating time can be cut down.

Figure 6:
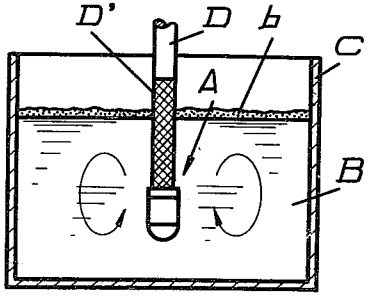
FIGS. 5 and 6 show how to treat molten metal by using the members shown in FIGS. 1 through 4.

The embodiment shown in FIG. 6 utilizes an improvement in a conventional device, wherein D designates a plunging member and A designates said capsule packed with a treating agent. When the capsule A is plunged into the molten metal B by the plunging member D, the self-burning and eruptive actions of the paper tube 2 cause the agitation and convection of the molten metal B, so that there is no need for the plunging member D to execute agitating motion and hence the surface of the melt can be kept undisturbed. Therefore, there is no possibility that the sulfur which has formed into slag b will return to the molten metal. Further, if the front end portion of the plunging member D is covered with a special heat-resistant paper tube D', the plunging member D will not be melt-wise damaged and it is only necessary to replace the inexpensive special paper tube D' and hence the running cost can be reduced.

Figure 4:
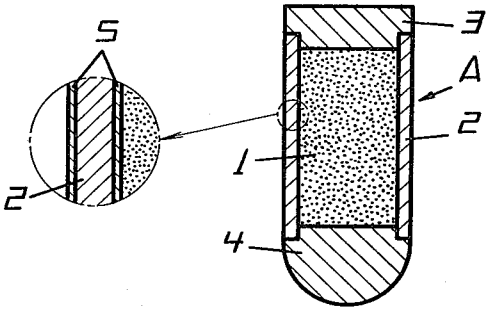
FIGS. 1, 3 and 4 are longitudinal sections of treating agent adding members showing embodiments of the invention which are used according to the present method of adding a treating agent.

In the embodiment shown in FIG. 4, designated at 5 are sealing members for protecting the quality of the treating agent 1 contained in the paper tube 2 by preventing the spontaneous ignition due to its time-dependent changes or by preventing the weathering of the treating agent due to its time-dependent changes. The sealing members are made of a material, which when melted, is harmless to the molten metal and they are, for example, in the form of tubes of thin metal foil or asbestos paper which cover the inner and outer peripheral surfaces of the paper tube 2 or which are wrapped around together with kraft paper when the latter is wound. Thus, the sealing members keep the treating agent 1 in the capsule A out of contact with the outside air to protect it from denaturing and enable it to be used in the most effective condition.

Figure 7:
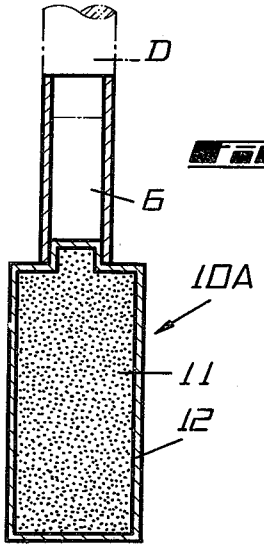
FIG. 7 is a longitudinal section of a treating agent adding member according to a further embodiment of the invention.

In FIG. 7, showing another embodiment, a treating agent adding member 10A comprises a capsule 12 made of a material which, when melted, is harmless to molten metal and having a treating agent 11 enclosed therein, and an auxiliary member 6 projecting from the upper end of the capsule 12 for contact with the holder D of a plunging device. The auxiliary member 6 is cylindrically formed by winding kraft paper in layers. However, it is not limited thereto and it may be formed by similarly shaping asbestos paper or by boring wood so long as it is made of a self-burnable and self-eruptive material.

Figure 8:
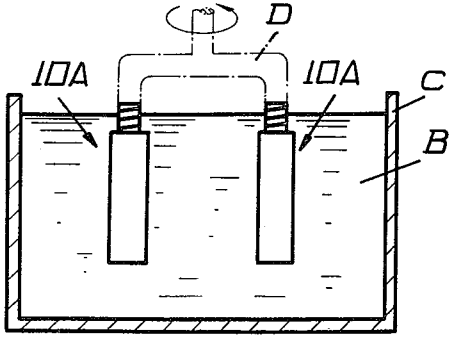
FIG. 8 shows a manner of treatment using the member shown in FIG. 7.

As for the manner of treatment in this case, as shown in FIG. 8, the adding members 10A are suspended from the holder D of the plunging device and plunged into molten metal B in a ladle C, the capsules 12 are melted to allow the treating agent 11 to be dispersed in the molten metal B, while some of the treating agent which tends to float up to the surface of the melt before it reacts with the molten metal is caused to stay in the molten metal by the self-burning of the auxiliary member 6 and by the fact that the concomitant emission of combustion gas causes bubbling. At the same time, the agitation and convection of the molten metal B are induced and the treating agent 11 reacts and is added.

Figure 10:
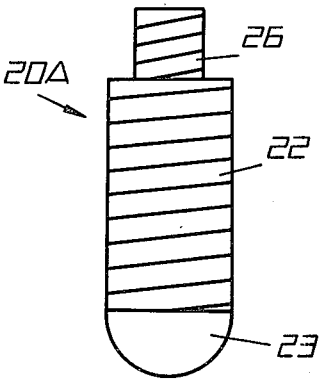
FIG. 10 is a front view of the member shown in FIG. 9.
Figure 9:
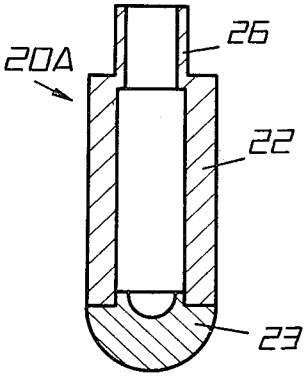
FIG. 9 is longitudinal section of a treating agent adding member according to another embodiment of the invention.
Figure 12:
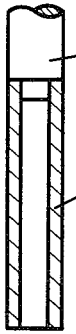

FIGS. 9 and 10 show a treating agent adding member according to another embodiment of the invention, wherein 22 designates a tubular body; 23, a lid; and 38 designates a connecting tube for connection to the holder of a plunging device or agitating device. The tubular body 22 and connecting tube 26 are cylindrically formed by winding a self-burnable and self-eruptive material, for example, kraft paper in layers as in the case of the paper tube 2 described above. However, no treating agent is packed therein. Therefore, as shown in FIG. 12, the lower end of the tubular body 22 may be left open without providing a lid.

Figure 11:
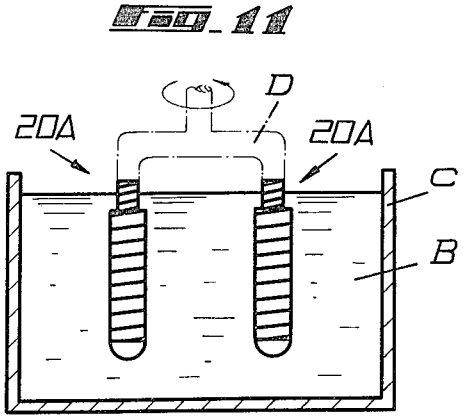
FIG. 11 shows a manner of treatment using the member shown in FIG. 9.

As for the manner of treatment in this case, as shown in FIG. 11, the treating agent adding members 20A of the above construction are suspended from the holder D of a plunging device and they are plunged into molten metal B taken out into a ladle C as soon as a treating agent is charged thereinto in the conventional manner. Then, the self-burning of the tubular bodies 22 in the molten metal B and the concomitant emission of gas induce bubbling, causing the agitation and convection of the molten metal B whereby the molten metal and the treating agent are agitated. In addition, if the plunging device is rotated, the effect of addition of the treating agent is further enhanced.

In order to effectively carry out the agitation described above, it is necessary to adjust the combustion time by adjusting the wall thickness of the tubular body 22. For example, if the combustion time of the tubular 22 is made substantially equal to the time necessary to chemical reaction between the treating agent and molten iron, this is most effective and the loss of the thermal energy of the molten iron can be minimized.

Figure 13:
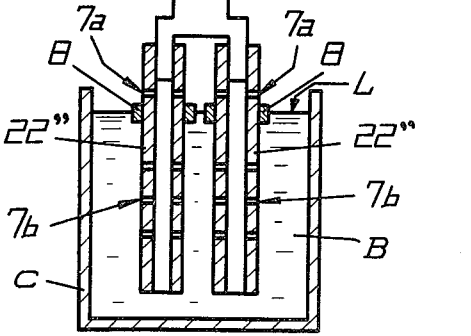
FIGS. 12 and 13 are longitudinal sections showing modifications wherein the member shown in FIG. 9 is improved.

Further, depending upon the volume of the molten metal B, etc., not less than two members 20A may be installed, and according to this arrangement, even if the plunging device is to be rotated, there is no possibility of the driving device, etc. having to be made larger in size at the sacrifice of the increase of the initial cost, since the resistance encountered during agitation is small as compared with that for a conventional iron vane even if the volume of the molten iron is large. Further, in embodying the present invention, as shown in FIG. 13, it is necessary to provide a number of small holes at two places on the tubular body 22'' for example, one place immersed in molten metal and the other above the surface L of the melt. The absence of such small holes would involve the danger of the tubular body 22'' being disengaged from the holder D by the expansion of the air in the hollow space of the tubular body 22''. When the inside air is expanded, it is the small holes **7*a* in the upper region that allow the air to escape, while the small holes 7*b* existing in the molten metal B serve to increase the combustion area. it is preferable that a band 8 made of a refractory material or the like be provided on the tubular body 22''** between the molten metal B and the outside air to prevent the holder from being damaged by the creeping up of the molten metal.

Figure 14:
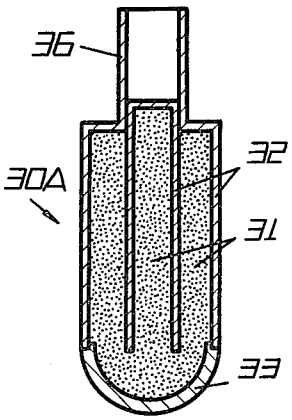
FIG. 14 is a longitudinal section of a treating agent adding member showing another embodiment of the invention.

In FIG. 14, showing a further embodiment of the invention, an adding member 30 comprises tubular 32 bodies, a lid 33 and a connecting tube 36, with a suitable amount of treating agent 31 packed therein. The tubular bodies 32 and connecting tube 36 are cylindrically formed by winding a material which, when melted, has no adverse influences on the components of the molten metal, for example, kraft paper in layers. The connecting tube 36 is used for connection to the holder of a plunging device.

The manner of treatment in this case is similar to that described in connection with FIG. 11. Thus, a suitable number of treating agent adding members 30A of the above construction are each packed with a suitable amount of treating agent 31 and they are suspended from the holder D of a plunging device and plunged into molten metal B taken out into a ladle C. The members 30A carry the treating agent 31 contained therein to suitable positions in the molten metal B and then the selfburning of the tubular bodies 32 in the molten metal B and the concomitant emission of combustion gas produce bubbling which, in turn, induces the agitation and convection of the molten metal, whereby the molten metal B and treating agent 31 are agitated and react with each other. Thereafter, the plunging operation described above is repeated several times.

In addition, in the illustrated example, two treating agent adding members are used, but when the amount of molten metal is relatively small, a single member may be repeatedly plunged. Further, when the amount of molten metal is large, not less than two members may be disposed at several places and plunged simultaneously or successively one by one, two by two, and so on.

By the operation described above, the addition of a treating agent can be made relatively simply and effectively carried out.

Figure 16:
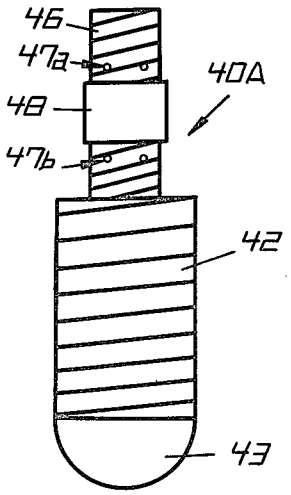
Figure 15:
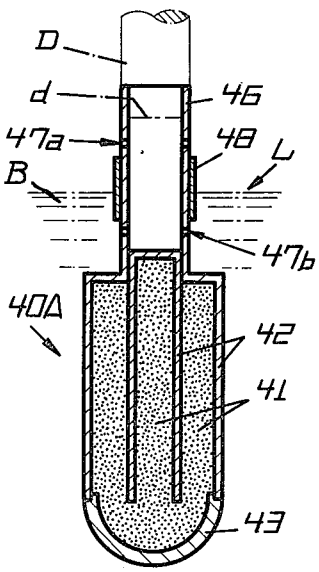

In practice, the member is arranged as shown in FIGS. 15 and 16. More particularly, the resistance of the molten metal B during agitation is concentrated on a region of the connecting tube 46 near the surface L of the melt and said region is accompanied by a splash phenomenon. If the connecting pipe 46 is broken thereby, the agitation effect would be decreased. Therefore, it is necessary to reinforce the same from the standpoint of strength and in view of splash. To this end, the region of the connecting tube 46 near the surface L of the melt is covered with a metal barrel or a refractory material 48.

With the combustion of the tubular bodies 42 and the emission of gas, the treating agent 11 is spouted into the molten metal, but some of the treating agent tends to float up to the surface of the melt before it reacts with the molten metal. In order to prevent this and improve the efficiency of addition, small holes **47*b* are formed in the connecting tube 46 below the surface of the melt. Then, combustion gas is emitted vigorously particularly around said small holes 47*b***, whereby the treating agent which tends to float up to the surface of the melt can be retained in the molten metal.

As the combustion of the tubular body 42 advances, the agitating action causes the molten metal B to fill the connecting tube 46 and the metal can easily stick to the front end d of the holder. In order to prevent this, small holes **47*a* are formed in the connecting tube 46 below the front end d of the holder. These small holes 47*a* allow the air filling the connecting pipe 46 to escape therethrough to the outside of the connecting tube 46. The fact that the molten metal B enters the connecting tube 46 means that the combustion of the tubular bodies 42 has advanced and hence the treating agent 41 has been spouted into the molten metal and its reaction with the latter has advanced. At this point of time, therefore, even if the connecting tube 46 is broken at the region of said small holes 47*a* or 47*b*, this does not cause any trouble. Further, since addition is accelerated in two ways, i.e., by agitation due to the entire treating agent adding member 40A and by the agitation and convection of the molten metal due to the selfburning and eruptive action of the tubular bodies 42, not only is the improvement of the treating effect achieved but also the loss of the energy of the molten metal is minimized by reduced operating time and the combustion of the agitating member 10**.

Figure 17:
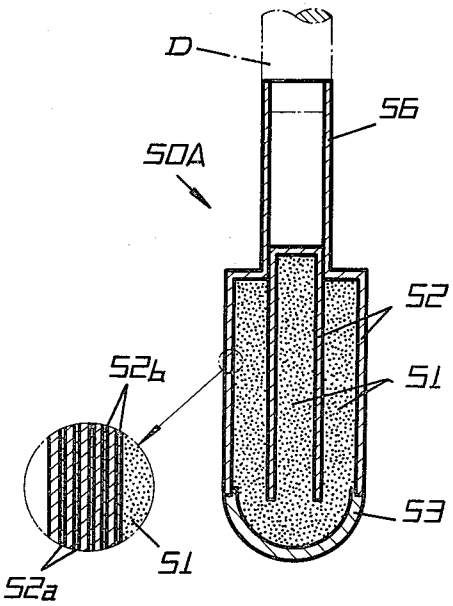
FIG. 17 is a longitudinal section of a treating agent adding member showing another embodiment of the invention.

FIG. 17 shows a treating agent adding member 50A according to the invention used for deoxidation. Tubular bodies 52 and a connecting member 56 are cylindrically formed by winding in layers a material which, when melted, is harmless to the components of molten metal, for example, kraft paper together with a deoxidizing material formed into a thin sheet or wire, for example, an aluminum foil **52*b*. Therefore, in a treating process, the self-burning of the tubular bodies 52 in the molten metal and the concomitant emission of combustion gas produce bubbling which, in turn, induces the agitation and convection of the molten metal, whereby the metal consisting of the molten metal and the treating agents, namely, the deoxidizing agent 51 and aluminum foil 32*b* is agitated. In this case, addition is accelerated in two ways, i.e., by the synergistic effect of the deoxidizing material included in the tubular bodies 52 and the deoxidizing agent enclosed in the interior and by the agitation and convection of the molten metal brought about by the selfburning and eruption of the tubular bodies 52**.

Figure 18:
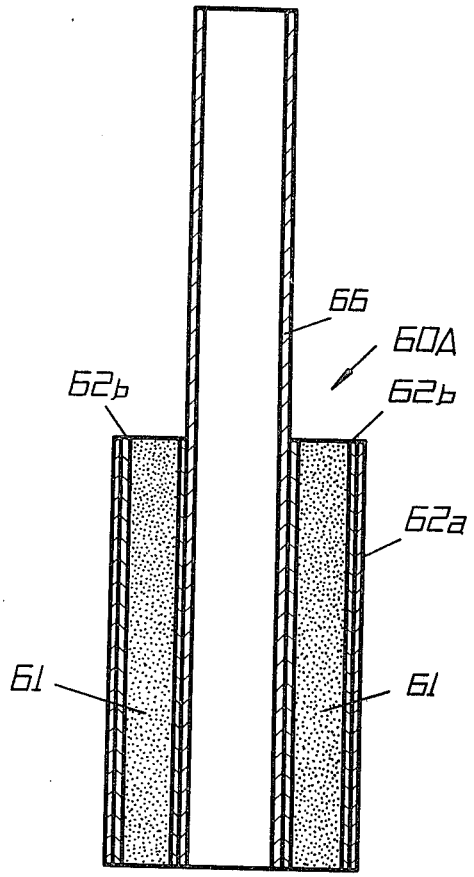
FIGS. 18 and 19 show a member for adding a treating agent for molten metal according to another embodiment of the invention.
Figure 19:
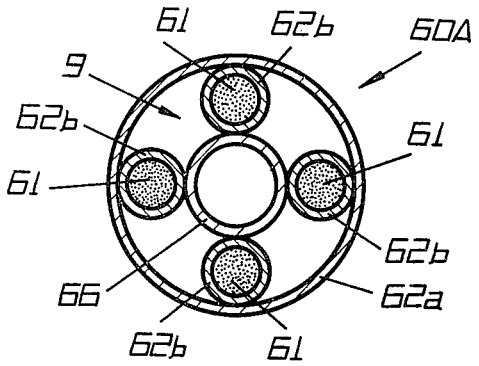

In the embodiment shown in FIGS. 18 and 19, a treating agent adding member is designated at 60A and **62*a* designates a tubular body and 66 designates a connecting tube, these being arranged in multiple construction (double construction in the illustrated example) wherein a plurality (four in the illustrated example) of containers 62*b* each containing a suitable amount of treating agent 61 are received in a hollow space 9 defined between the tubular body 62*a* and the connecting tube 66. The tubular body 62*a* and connecting tube 66 are cylindrically formed by winding, for example, kraft paper in layers, while the containers 62*a* are in the form of barrels of different materials (for example, a paper barrel made of a self-burnable and self-eruptive material similar to that for said tubular body 62*a* and connecting tube 66**, a barrel of thin metal, a barrel refractory material and a barrel of asbestos paper) or barrels of the same material with different wall thicknesses. Such materials should, of course, be harmless to molten metal when melted.

According to this arrangement, the containers **62*a* are successively melted in the order of decreasing melting rate to allow the treating agent 61 in each container to be spouted and the molten metal and treating agent are agitated and react with each other. In brief, there is a time lag in chemical reaction of the treating agent due to differences in the melting rate of the containers 62*b*** in molten metal, whereby a diffusion effect is obtained, improving the treating effect and saving the operating time.

While there have been described herein what are at present considered preferred embodiments of the several features of the invention it will be obvious to those skilled in the art that modifications and changes may be made without departing from the essence of the invention.

It is therefore to be understood that the exemplary embodiments thereof are illustrative and not restrictive of the invention, the scope of which is defined in the appendd claims and that all modifications that come within the meaning and range of equivalency of the claims are intended to be included therein.

I claim:

1. A member for adding a treating agent for molten metal, comprising a paper tube formed of kraft paper wound in layers, an air layer being formed between adjacent paper layers, a lid and a weight which are made of a metal for tightly closing opposite ends of said paper tube, and a treating agent packed in said paper tube.

2. A member for adding a treating agent for molten metal, characterized in that an auxiliary member made of a self-burnable and self-eruptive material formed of paper cylindrically wound in layers, an air layer being formed between adjacent paper layers, is provided on and projects from a capsule containing a treating agent, said capsule being adapted to be suspended from a plunging device through said auxiliary member.

3. A member for adding a treating agent for molten metal, characterized in that a tubular body made of self-burnable and self-eruptive material formed of paper cylindrically wound in layers, an air layer being formed between adjacent paper layers, has a lid secured to one end thereof and a connecting tube projecting from the other end thereof for connection to an agitating device or a plunging device.

4. A member for adding a treating agent for molten metal, comprising a tubular body and a connecting tube which are made of a self-burnable and self-eruptive material formed of paper cylindrically wound in layers, an air layer being formed between adjacent paper layers, and which are arranged in multiple construction, and several containers each containing a suitable amount of the same kind of treating agent, said containers being received in a hollow space defined between said tubular body and connecting tube.

5. A member for adding a treating agent for molten metal as set forth in claim 1, characterized in that said paper tube is of multiple construction wherein a central paper tube has its hollow space left vacant while a hollow space defined by an outer paper tube is packed with a treating agent.

6. A member for adding a treating agent for molten metals as in claim 1, characterized in that an inner and an outer peripheral surface of said paper tube are covered with air-tight members.

7. A member for adding a treating agent for molten metal as in claim 1, characterized in that an air-tight member is wrapped in together with said tube.

8. A member for adding a treating agent for molten metals as in claim 3, characterized in that a treating agent is packed in the interior.

9. A member for adding a treating agent for molten metals as in claim 8, characterized in that a plurality of small holes are formed in said connecting tube at a position below a surface of the melt and at a second position below a front end of a holder of a plunging device.

10. A member for adding a treating agent for molten metals as set forth in claim 8, characterized in that a plurality of small holes are formed in said connecting tube at a position below a surface of a melt and at a second position below a front end of an agitating device.

11. A member for adding a treating agent for molten metals as in claim 8, characterized in that a deoxidizing material formed in a thin sheet is interlaced with said tubular body.

12. A member for adding a treating agent for molten metals as set forth in claim 8, characterized in that a deoxidizing material formed into a wire is interlaced with said tubular body.

13. A member for adding a treating agent for molten metals as in claim 4, characterized in that each of said containers contains a different kind of treating agent with respect to each of the other containers.

* * * * *